US009028211B2

(12) United States Patent
Todd, Jr.

(10) Patent No.: US 9,028,211 B2
(45) Date of Patent: May 12, 2015

(54) LIGHTING AND HEATING ASSEMBLY FOR A CEILING FAN

(75) Inventor: Alvin E. Todd, Jr., Pigeon Forge, TN (US)

(73) Assignee: Alvin E. Todd, Jr., Pigeon Forge, TN (US)

( * ) Notice: Subject to any disclaimer, the term of this patent is extended or adjusted under 35 U.S.C. 154(b) by 677 days.

(21) Appl. No.: 12/862,417

(22) Filed: Aug. 24, 2010

(65) Prior Publication Data

US 2010/0316495 A1 Dec. 16, 2010

Related U.S. Application Data

(63) Continuation-in-part of application No. 11/935,855, filed on Nov. 6, 2007, now abandoned.

(51) Int. Cl.
*F04D 25/08* (2006.01)
*F04D 29/58* (2006.01)

(52) U.S. Cl.
CPC ..... *F04D 25/088* (2013.01); *F04D 29/582* (2013.01); *F04D 29/584* (2013.01)

(58) Field of Classification Search
CPC .... F04D 25/088; F04D 29/582; F04D 29/584
USPC ..... 415/121.2; 416/5, 146 R, 247 R
See application file for complete search history.

(56) References Cited

U.S. PATENT DOCUMENTS 332,821 A 12/1885 Murray, Jr.
1,226,734 A 5/1917 Work
1,383,564 A 7/1921 Phillipson
1,388,822 A 8/1921 Roys
1,389,235 A 8/1921 Zieley
1,399,931 A 12/1921 Clutts
1,472,124 A 10/1923 Morgan et al.
1,499,894 A 7/1924 Waterman
1,687,544 A 10/1928 Clark et al.
1,723,405 A 8/1929 Carmean
1,813,023 A 7/1931 Cheslock et al.
2,262,898 A 11/1941 MacGregor
2,274,935 A 3/1942 Naul
2,411,782 A 11/1946 Gardes
2,619,578 A 11/1952 Jepson et al.
3,296,738 A 1/1967 Weigel
4,064,427 A 12/1977 Hansen et al.
4,428,032 A 1/1984 Workman
4,455,449 A * 6/1984 Rendel ..... 174/53
4,504,191 A 3/1985 Brown
4,508,958 A 4/1985 Kan et al.
4,657,485 A * 4/1987 Hartwig ..... 416/247 R
4,782,213 A 11/1988 Teal (Continued)

*Primary Examiner* — Nathaniel Wiehe
*Assistant Examiner* — Sean J Younger
(74) *Attorney, Agent, or Firm* — Pitts & Lake, P.C.

(57) ABSTRACT

A lighting and heating assembly is provided. The lighting and heating assembly is configured for mounting to an existing ceiling fan. The lighting and heating assembly includes a lighting assembly for distributing light and a heating assembly for providing heat to the air circulated by the ceiling fan. The lighting assembly is attachable to the ceiling fan and has the heating assembly detachably connected thereto, which allows the lighting assembly to be used without the heating assembly. Additionally, the lighting and heating assembly is adjustable such that the lighting assembly and/or heating assembly are repositionable at desired locations in relation to one another and the air flow generated by the ceiling fan.

20 Claims, 10 Drawing Sheets

(56) References Cited

U.S. PATENT DOCUMENTS

| | | | | | |
|---|---|---|---|---|---|
| 5,077,825 | A | | 12/1991 | Monrose | |
| 5,224,830 | A | | 7/1993 | Wang | |
| 5,292,228 | A | | 3/1994 | Dye | |
| 5,333,235 | A | | 7/1994 | Ryder | |
| 5,349,513 | A | * | 9/1994 | Taylor, III | 362/404 |
| 5,404,284 | A | | 4/1995 | Davis, Jr. | |
| 5,440,459 | A | | 8/1995 | Chan | |
| 5,454,692 | A | | 10/1995 | Davis, Jr. | |
| 5,528,469 | A | | 6/1996 | Todd, Jr. | |
| 5,545,009 | A | | 8/1996 | Ke | |
| D381,074 | S | | 7/1997 | Pelonis | |
| 5,668,920 | A | | 9/1997 | Pelonis | |
| 5,672,002 | A | | 9/1997 | Todd, Jr. | |
| 5,687,068 | A | * | 11/1997 | Jamieson et al. | 363/126 |
| 5,800,049 | A | | 9/1998 | Todd, Jr. | |
| 5,847,636 | A | * | 12/1998 | Sehlhorst | 337/303 |
| 5,877,670 | A | * | 3/1999 | Sehlhorst et al. | 337/302 |
| 6,019,577 | A | | 2/2000 | Dye | |
| 6,062,816 | A | | 5/2000 | Chang | |
| 6,086,226 | A | | 7/2000 | Chang | |
| 6,089,725 | A | | 7/2000 | Chen | |
| 6,160,956 | A | | 12/2000 | Pelonis | |
| 6,213,617 | B1 | | 4/2001 | Barker | |
| 6,224,226 | B1 | | 5/2001 | Bucher et al. | |
| 6,240,247 | B1 | | 5/2001 | Reiker | |
| 6,244,820 | B1 | * | 6/2001 | Yilmaz | 416/146 R |
| 6,322,232 | B1 | | 11/2001 | Oliver | |
| 6,366,733 | B1 | | 4/2002 | Reiker | |
| 6,438,322 | B1 | | 8/2002 | Reiker | |
| 6,631,243 | B2 | | 10/2003 | Reiker | |
| 6,676,375 | B2 | | 1/2004 | Steeves LeBlanc et al. | |
| 6,682,303 | B2 | | 1/2004 | Wu | |
| 6,751,406 | B2 | | 6/2004 | Reiker | |
| 7,318,701 | B2 | * | 1/2008 | Farmer | 416/5 |
| 8,107,797 | B2 | * | 1/2012 | Abodreham et al. | 392/361 |
| 2002/0021891 | A1 | | 2/2002 | Reiker | |
| 2002/0064380 | A1 | | 5/2002 | Reiker | |
| 2002/0081107 | A1 | | 6/2002 | Reiker | |
| 2003/0223869 | A1 | | 12/2003 | Wu | |
| 2003/0228142 | A1 | | 12/2003 | Reiker | |
| 2004/0247440 | A1 | | 12/2004 | Boubin | |
| 2006/0078460 | A1 | * | 4/2006 | Ryu et al. | 422/5 |
| 2006/0209532 | A1 | | 9/2006 | Hardgrave | |
| 2006/0285310 | A1 | | 12/2006 | Shyu | |

* cited by examiner

LIGHTING AND HEATING ASSEMBLY FOR A CEILING FAN

CROSS-REFERENCE TO RELATED APPLICATIONS

This application is a Continuation-In-Part of U.S. application Ser. No. 11/935,855, filed Nov. 6, 2007.

STATEMENT REGARDING FEDERALLY-SPONSORED RESEARCH OR DEVELOPMENT

Not Applicable

BACKGROUND OF THE INVENTION

1. Field of Invention

The present invention relates to ceiling fans. More particularly, this invention relates to an external assembly for a ceiling fan.

2. Description of the Related Art

Typically ceiling fans have been used to circulate air within a warm environment. For a given environment, it is well known that warmer air generally occupies the area adjacent to the top of the environment and the cooler air generally occupies the area adjacent to the bottom of the environment. The air circulated by the ceiling fan essentially distributes the warmer air and cooler air within the environment such that a person experiences a cooling effect due to the air movement. Thus, typical ceiling fans only circulate air within the environment to create a cooling effect.

Accordingly, use of ceiling fans is generally limited to warm environments because they do not alter the temperature of the air being circulated. Cold environments are an exemplary example where ceiling fans are largely ineffective due to the cooling effect caused by the circulation of air within the environment.

BRIEF SUMMARY OF THE INVENTION

A lighting and heating assembly for a ceiling fan is described in herein and illustrated in the accompanying figures. The lighting and heating assembly is configured for use with an existing ceiling fan that is mounted to a ceiling and includes a plurality of rotatable fan blades, which circulate air within an environment. The ceiling fan also includes an attachment interface and an electrical connection for securing and providing external assemblies.

The lighting and heating assembly includes two main components, namely a lighting assembly and a heating assembly. The lighting and heating assembly includes a lighting assembly for distributing light and a heating assembly for providing heat to the air circulated by the ceiling fan. The lighting assembly is attachable to the ceiling fan and the heating assembly detachably connected to the lighting assembly, which allows the lighting assembly to be used without the heating assembly.

Additionally, the lighting and heating assembly is adjustable such that the lighting assembly and/or heating assembly are repositionable at desired locations in relation to one another and the air flow generated by the ceiling fan. Specifically, the lighting assembly includes a plurality of telescoping arms that extend outwardly and carry a socket in electrical communication with the electrical connection such that a light bulb provides adjustable lighting for an environment. The heating assembly includes a heating element supported by a thermally isolated heating element cage that provides protection from thermal injuries typically received from contact with an energized heating element.

Furthermore, the lighting and heating assembly provides a plurality of light bulb shields. Generally, the light bulb shields are aesthetically pleasing and are arranged such that unsightly low wattage light bulbs are removed from significant view. Alternatively, the light bulb shields may be configured to provide protection for the light bulbs such that the light bulb is not affected by heat generated by the heating assembly.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A lighting and heating assembly for a ceiling fan is described in detail herein and illustrated in the accompanying figures. The lighting and heating assembly is configured for mounting to an existing ceiling fan. The lighting and heating assembly includes a lighting assembly for distributing light and a heating assembly for providing heat to the air circulated by the ceiling fan. The lighting assembly is configured to attach to the ceiling fan and has the heating assembly detachably connected thereto, which allows the lighting assembly to be used without the heating assembly. Additionally, the lighting and heating assembly is adjustable such that the lighting assembly and/or heating assembly are repositionable at desired locations in relation to one another and the air flow generated by the ceiling fan.

Figure 1:
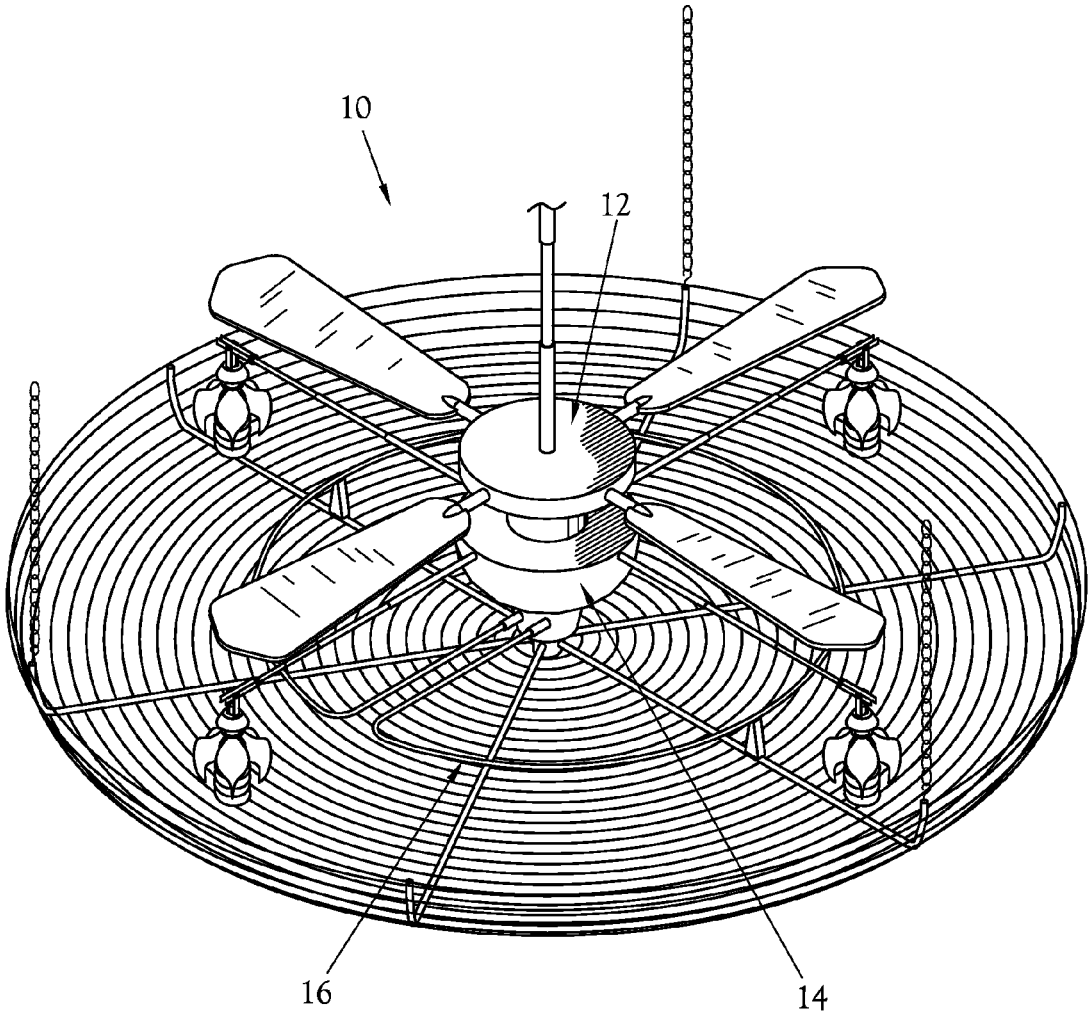
FIG. 1 is a perspective view of one embodiment of the present invention.

FIG. 1 illustrates one embodiment of a lighting and heating assembly 10 for a ceiling fan 12. As illustrated, the lighting and heating assembly 10 is attachable to the ceiling fan 12 and includes two main components, namely a lighting assembly 14 and a heating assembly 16.

Figure 2:
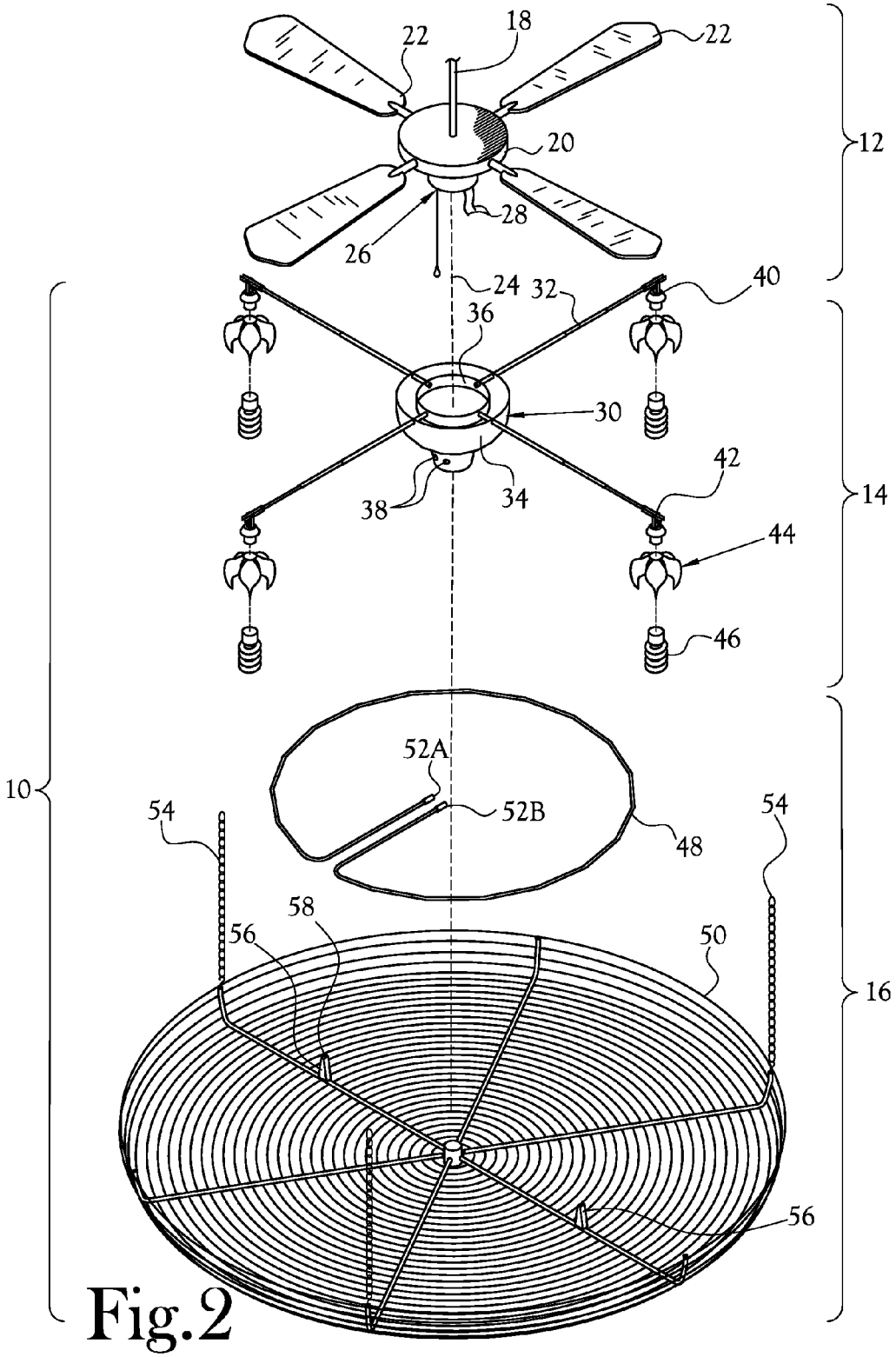
FIG. 2 is an exploded view of the embodiment of the present invention depicted in FIG. 1.

FIG. 2 illustrates an exploded view of the embodiment of the lighting and heating assembly 10 and the ceiling fan 12 depicted in FIG. 1. The lighting and heating assembly 10 is attachable to a ceiling fan 12, which is mounted to a ceiling, or other structural support, and provides circulation for an environment. In the depicted embodiment, the ceiling fan 12 is suspended by tubing 18, such as a downrod, that allows the ceiling fan 12 to be mounted to variable height structures, e.g., standard and lofted ceilings. The tubing 18 also provides a conduit through which wiring extends from the ceiling to the ceiling fan 12 for providing power. The ceiling fan 12 includes a fan housing 20 that encloses a conventional fan motor (not shown) having a plurality of fan blades 22. The fan blades 22 being arranged to generate air circulation. For example, in FIG. 2, the fan blades 22 are fabricated of wood, or other suitable material, in an oblong shape, in which two elongated sides are substantially parallel, one end defining a semicircle, and the other end having a decorative curve that forms a point, or shape with dimensions that are effective for creating air circulation. The fan blades 22 extend outward at equally spaced intervals around a vertical axis 24, as depicted in FIG. 2, defined by the ceiling fan 12. A rigid arm mounts the semicircle end of the fan blade 22 to a conventional fan motor at a desired angle such that, upon rotation of the fan blades 22, air is circulated. Furthermore, the bottom of the fan housing 20 provides an attachment interface 26 for securing external assemblies to the ceiling fan 12 and an electrical connection 28 for providing power to an external assembly. The fan housing 20 also provides controls, as depicted by pull-chains in FIG. 2, for the operation of the ceiling fan 12, and any attached external assembly. Alternatively, fan controls may be provided through wall-mounted or radio frequency devices.

The lighting assembly 14, illustrated in FIG. 2, includes a housing 30 and one or more lighting arms 32. The housing 30 is attachable to the ceiling fan 12 and encloses electrical components of the lighting assembly 14. In the illustrated embodiment, the lighting assembly 14 is secured to the attachment interface 26 of the ceiling fan 12 by fasteners, for example bolts. The light assembly housing 30 includes a casing 34, which encloses a frame 36 configured to support a plurality of lighting arms 32. As an example, in the illustrated embodiment, the casing 34 has an inverted bell shape, with a larger diameter at the top that tapers to a smaller diameter at the bottom. The casing 34 is open at the top such that the casing 34 receives a portion of the ceiling fan housing 20 when attached to the ceiling fan 12. Additionally, the lighting assembly housing 30 further includes an auxiliary connection 38 for attachment of the heating assembly 16 wherein the auxiliary connection 38 is in electrical communication with the electrical connection 38 provided by the ceiling fan 12.

The plurality of lighting arms 32 provides rigid support for the lighting. Generally, each of the lighting arms 32 is hollow such that electrical components are hidden. In FIG. 2, the plurality of lighting arms 32 are each fabricated from long, hollow, and cylindrically shaped tubing. Furthermore, in the illustrated embodiment, the lighting arms 32 are telescoping for allowing a desired amount of outward extension from the casing 34. For example, the length of the lighting arms 32 can extend outward farther from the vertical axis 24 than the rest of the lighting and heating assembly 10 such that the distribution of lighting is not effected.

The lighting arms 32 carry a light bulb socket 40 at the outboard end of each lighting arm 36. In one embodiment, a pivotal joint 42 is provided for each lighting arm 32 to allow adjustable orientation of the light bulb socket 40. For example, in the illustrated embodiment, the end of a lighting arm 32 includes a hinged connector for supporting a light bulb socket 40 and allowing the light bulb socket 40 to be pivoted in a desired direction. As depicted, the hinged connector is pivoted into a vertical orientation relative to the ground. In another embodiment, the hinged connector allows the light bulb socket 40 to pivot approximately 180 degrees along a vertical or horizontal axis. The lighting arms 32 carry a light bulb socket at the outboard end of each lighting arm 32 to rotate 360 degrees. FIG. 2 further depicts light bulbs shields 44, which are subsequently discussed in detail, being carried by each light bulb 46.

The lighting assembly 14 is powered by the ceiling fan 12 or other suitable power source. In the illustrated embodiment, the lighting assembly 14 is in electrical communication with the electrical connection 28 of the attachment interface 26 such that a user controls the lighting assembly 14 through the controls for the ceiling fan 12. The power supplied to the electrical connection 28 transfers power through wiring in the lighting arms 32 to the bulb sockets 40. In the illustrated embodiment, the light bulbs 46 secured to the light bulb sockets 40 are controlled by a switch or controller, such as a pull-chain.

The heating assembly 16 is supported by the ceiling fan and, more specifically, detachably mounted to the lighting assembly 14. The heating assembly 16 includes a heating element 48 and a heating element cage 50. The heating element 48 is generally positioned in communication with air flow produced by the ceiling fan 12. In the illustrated embodiments, the heating element 48 is positioned in a substantially horizontal plane, which is approximately parallel to the plane of the fan blades 22, allowing for direct exposure of the heating element 48 to the air flow generated by the ceiling fan 12. The heating assembly 16 is powered by a power supply which provides an effective amount of power for the heating element 48 to produce heat. In the illustrated embodiments, the heating element 48 has two terminals, namely a first terminal 52A and a second terminal 52B, which connect the heating element 48 in electrical communication with the auxiliary connection 38 of the lighting assembly 14. Additionally, the terminals 52A and 52B are readily detachable from the auxiliary connection 38 such that the heating assembly 16 is detachable from the lighting assembly 14.

The heating element cage 50 is permeable to air flow while providing support to the heating element 48 without significantly impeding the flow of air. In FIG. 2, the heating element cage 50 is disposed in a horizontal plane substantially parallel to the heating element 48 such that the heating element cage 50 provides support for the heating element 48 and restricts contact with the heating element 48. More specifically, the depicted heating element cage 50 comprises wire members formed into a configuration that provides large openings for air flow while producing an aesthetically pleasing design. It should also be noted that a large heating element cage 50 may require additional support for attachment to the lighting assembly 14 and ceiling fan 12. For example, in the illustrated embodiment, the heating element cage 50 is detachably connected to the ceiling by chains 54.

Additionally, in the illustrated embodiment, the heating element cage 50 supports the heating element 48 such that the heating element 48 is thermally isolated from the heating element cage 50 for providing protection from thermal injuries received from contact with an energized heating element 48. More specifically, the heating element cage 50 supports the heating element 48, in an elevated relationship to the heating element cage 50, by a plurality of heating element supports 56. The heating element supports 56 are disposed in spaced apart relationship to one another around the perimeter of the heating element 48. These heating element supports 56 are fixed to the cage 50 through welds or other suitable manner. In the illustrated embodiment, the heating element supports 56 are triangular-shaped and are situated with the base secured to the heating element cage 50 and the apex providing support for the heating element 48. More specifically, the depicted heating element supports 56 are ceramic insulators with semicircle indentations 58, which have an interior diameter substantially the same as the outer diameter of the heating element 48, at the apex of the triangle to support and mount the heating element 48 to the heating element cage 50. In alternate embodiments, the heating element supports 56 can be fabricated from another material suitable for insulating the cage 50 from heat produced by the heating element 48.

Figure 3A:
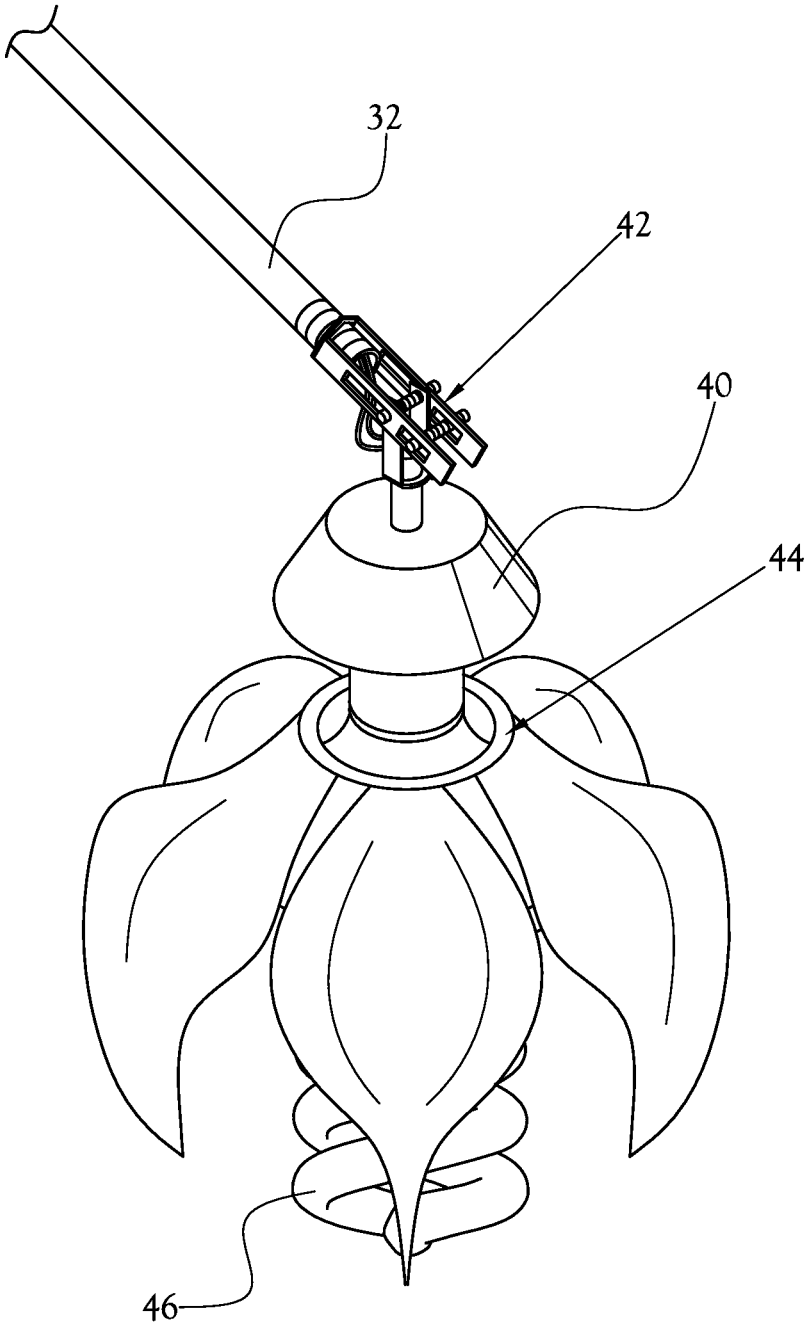
FIG. 3A is an enlargement of one embodiment of a light bulb shield having the front portion of shielding in hidden line to provide clarity of a low energy bulb shielded by the light bulb shield.
Figure 3B:
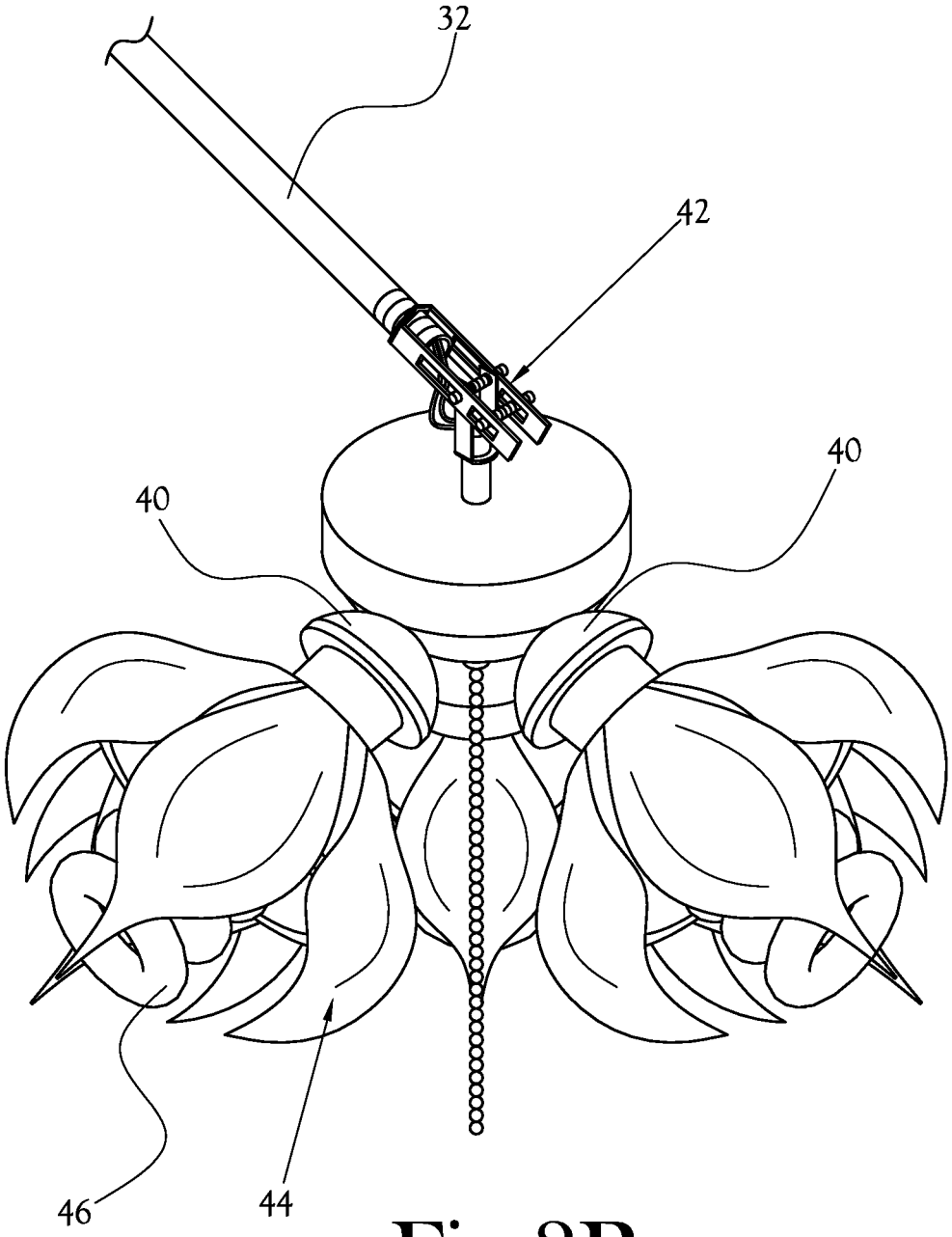
FIG. 3B is one embodiment of a cluster of light bulb shields and low energy bulbs.
Figure 3C:
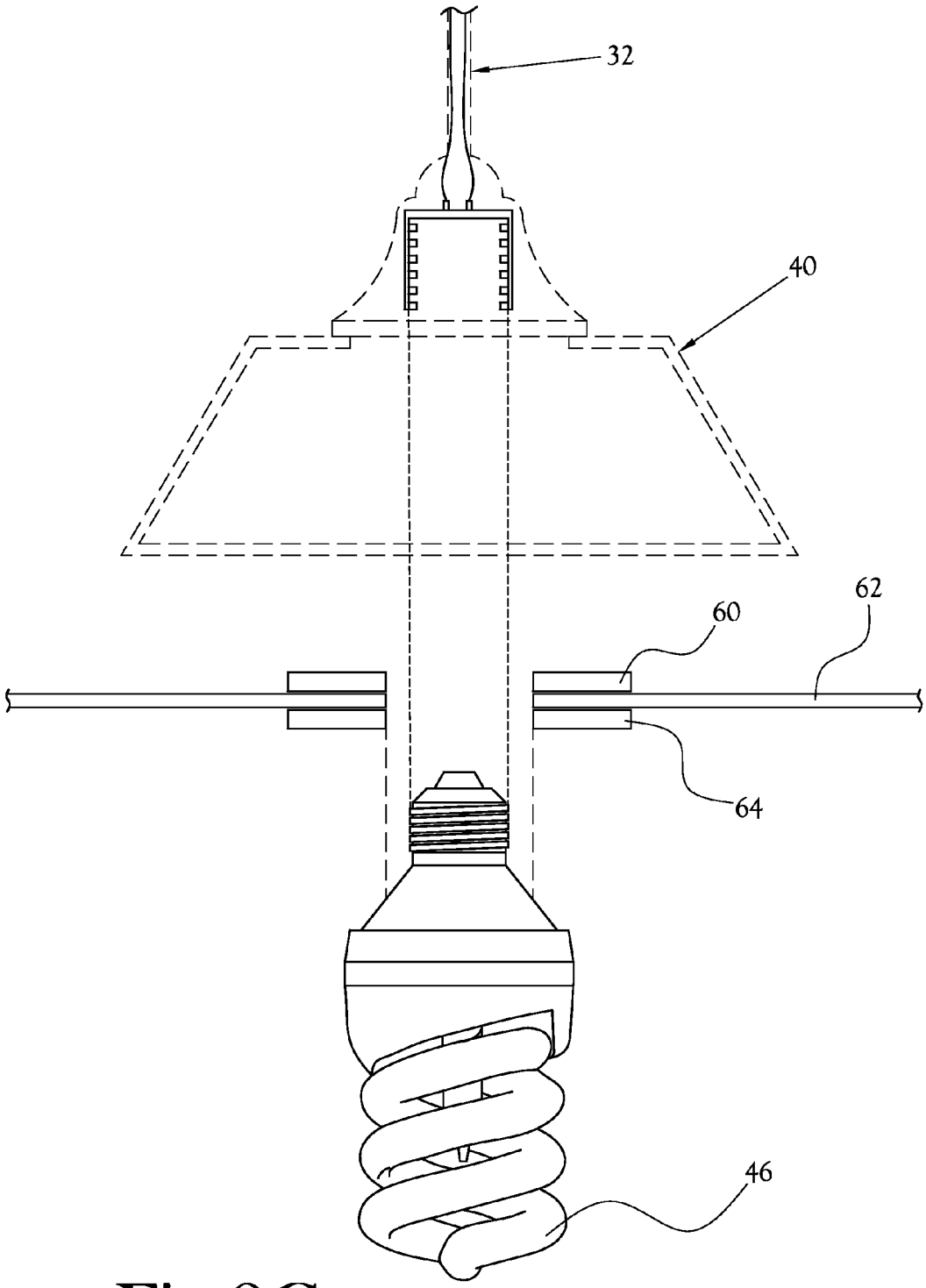
FIG. 3C is a sectional view of one embodiment of a light bulb shield in relation to the light bulb socket and a low energy bulb.

FIGS. 3A, 3B, and 3C illustrate embodiments of the light bulb shields 44 in greater detail. Each light bulb shield 44 is configured to be carried by a light bulb 46 such that at least a portion of the light bulb 46 is concealed. Generally, these light bulb shields 44 are arranged in an aesthetically pleasing design. For example, as shown in FIG. 3A and 3B, the light bulb shields 44 include an aesthetically pleasing arrangement of leaves removing the unsightly low wattage light bulbs 44 from significant view. Alternatively, the light bulb shields 44 provide protection for the light bulbs 46 such that the light bulb 46 is not affected by heat generated by the heating assembly 16. For example, the light bulb shields 44, for use while utilizing the heating assembly 16, offer increased protection for the light bulbs 46. More specifically, the light bulb shields 44 are fabricated from material which is heat resistant and noncombustible, whereby heat generated by the heating assembly 16 will not affect the performance of the light bulb 46. Additionally, as depicted in FIG. 3B, a cluster of light bulb shields 44 and light bulbs 46 offer increased lighting for an environment.

Generally, these light bulb shields 44 are secured to the light bulbs 46 such that the light bulb shields 44 hang from the light bulbs 46. FIG. 3C illustrates one embodiment of the light bulb 46 and a sectional view of the light bulb shields 44 in relation to the bulb socket 40, depicted in hidden line. The bulb socket 40 is configured to receive the threaded end of a light bulb 46 such that the light bulb 46. More specifically, the light bulb shield 44 defines a central opening through which a narrow portion of the light bulb (e.g., the neck) passes and the wider portion of the light bulb 46 (e.g., the body) is restricted from passing. As a result, the light bulb shield 44 rests on the light bulb 46 when secured to the bulb socket 40. In the illustrated embodiment, the light bulb shield 44 includes an upper ring 60, shielding 62, and a lower ring 64. As depicted, the upper ring 60 and lower ring 64 cooperate together to receive and secure shielding 62 there between, for example in one embodiment the shielding 62 is glued to upper ring 60 and lower ring 64. In alternate embodiments, the light bulb shield 44 includes, but is not limited to, a single ring, a decorative ring, covering for the rings, or forming a ring with the shielding 62.

Figure 4A:
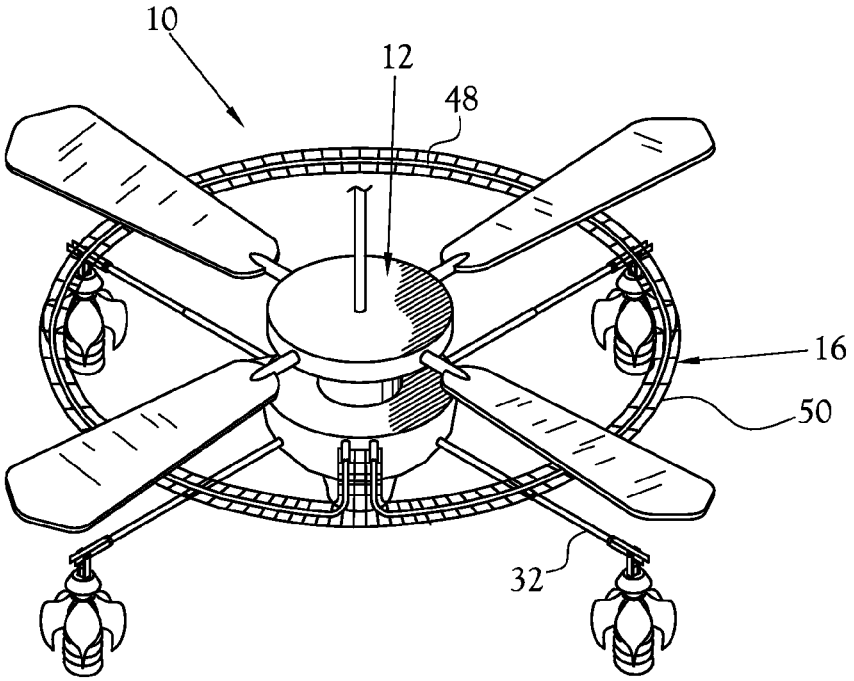
FIG. 4A is a perspective view of one embodiment of the present invention wherein the heating assembly is repositioned above the lighting assembly.
Figure 4B:
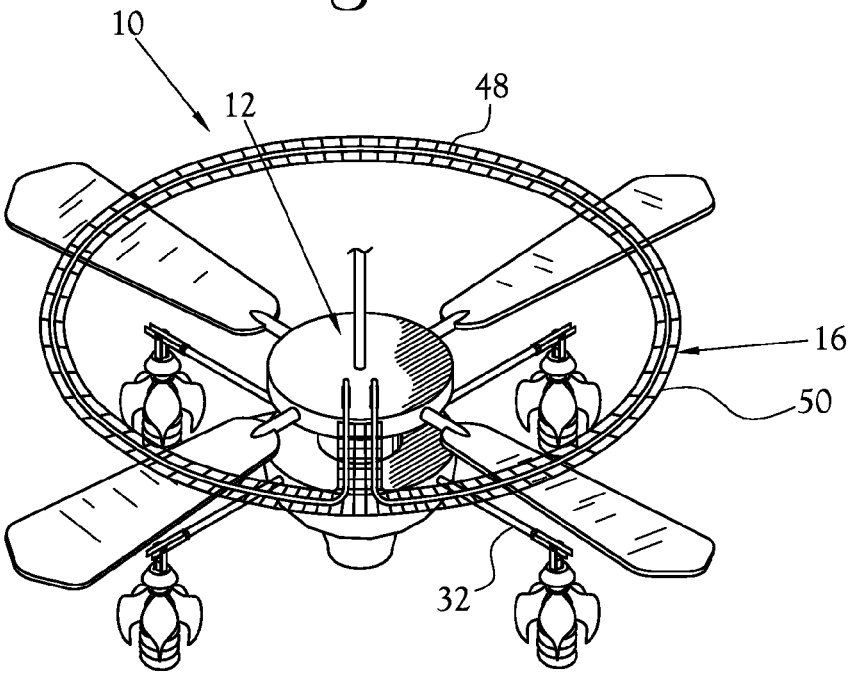
FIG. 4B is a perspective view of one embodiment of the present invention wherein the heating assembly is repositioned above the ceiling fan.

FIGS. 4A and 4B show alternate embodiments of the lighting and heating assembly for a ceiling fan 10 having an adjustable heating assembly 16, which allows the heating element 48 and heating element cage 50 to be repositioned relative to the air flow generated by the ceiling fan 12. It will be appreciated that the adjustable arrangements of the heating assembly 16 allow a user to selectively control the manner of lighting and heating for an environment. For example, the lighting arms 32 extend outward two lengths of tubing in FIG. 4A, but only one length of tubing in FIG. 4B.

In the embodiment illustrated in FIG. 4A, the heating assembly 16 is configured to provide sufficient heating for a selected area of the environment, which is essentially the area below the ceiling fan 12, while providing insufficient heating for the entire environment. More specifically, air directed downwards comes in contact with the heating element 48 such that the downward air flow is heated and thereby heating the isolated area below the heating assembly 16. For example, in a large environment, warm air near the top of the environment is directed downward into communication with the heating element, whereby the air is heated and directed into the localized area below the heating element such that a first person standing below the heating assembly 16 experiences a warmer temperature than a person standing away from the heating assembly 16. In this arrangement, the heating assembly 16 provides heat to an occupied area of an environment while eliminating the need to heat the entire environment.

Alternatively, in the embodiment illustrated in FIG. 4B, the heating assembly 16 is positioned above the ceiling fan 12 and the lighting assembly 14 such that the heating element 48 is positioned in communication with upward air flow produced by the ceiling fan 12. More specifically, air directed upwards comes in contact with the heating element 48 such that the air is heated and thereafter directed towards the perimeter of the environment and circulated within the environment. For example, in an environment such as a room, cool air in the environment is slowly directed upwards into communication with the heating element 48 such that the air is heated and directed towards the perimeter the environment and thereafter circulated into the environment. In this arrangement, the heating assembly 16 is responsible for providing heated air throughout the entire environment, such as a single room in a house, without requiring the heating of air in other environments, such as other rooms within a house. Accordingly, it is recognized that the adjustable arrangements of the heating assembly 16 allow a user to selectively control whether to provide heat for a small portion of an environment or the entire environment without heating neighboring environments thereby providing energy efficient heating for the user.

Figure 5A:
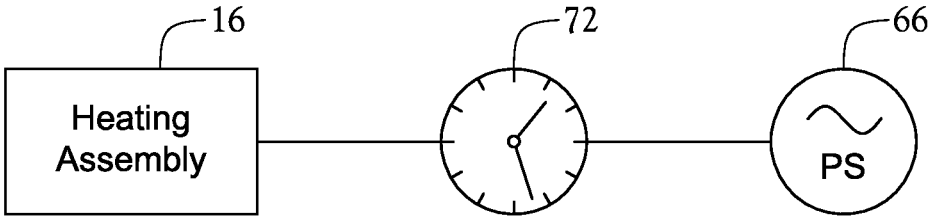
FIG. 5A illustrates a diagram of the power supply and a timer as represented by one embodiment of the present invention.
Figure 5B:
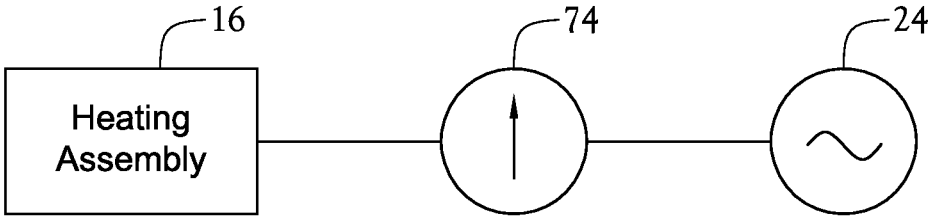
FIG. 5B illustrates a diagram of the power supply and a rheostat as represented by one embodiment of the present invention.
Figure 5C:
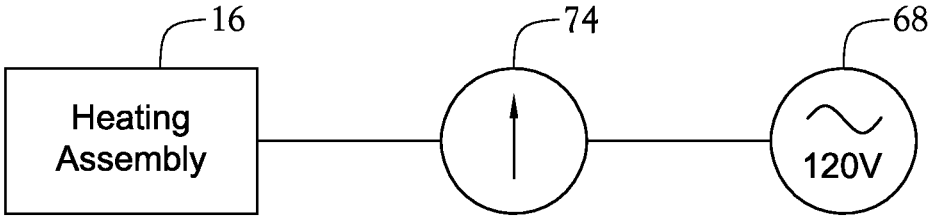
FIG. 5C illustrates a diagram of the power supply and a rheostat as represented by one embodiment of the present invention.
Figure 5D:
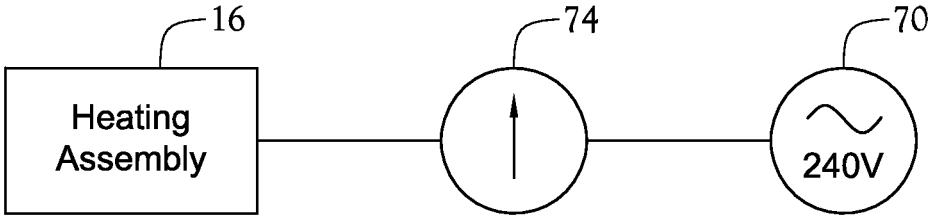
FIG. 5D illustrates a diagram of the power supply and a rheostat as represented by one embodiment of the present invention.
Figure 5E:
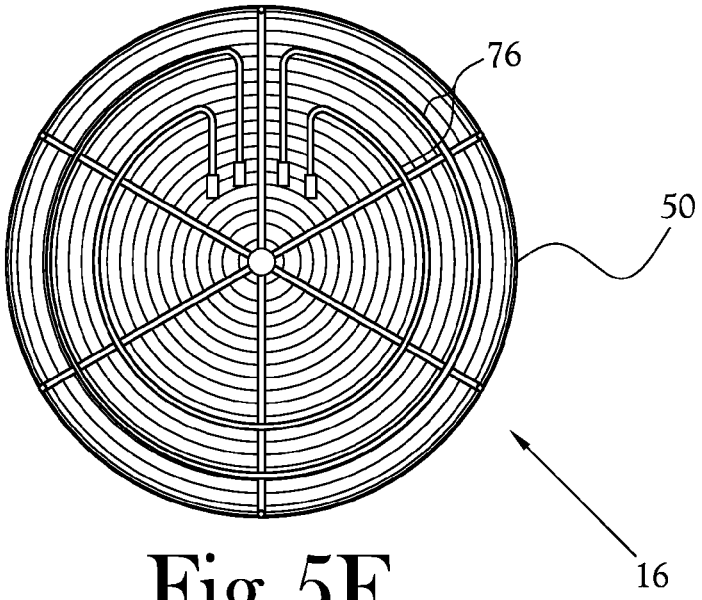
FIG. 5E is a perspective view of one embodiment of the heating element.
Figure 5F:
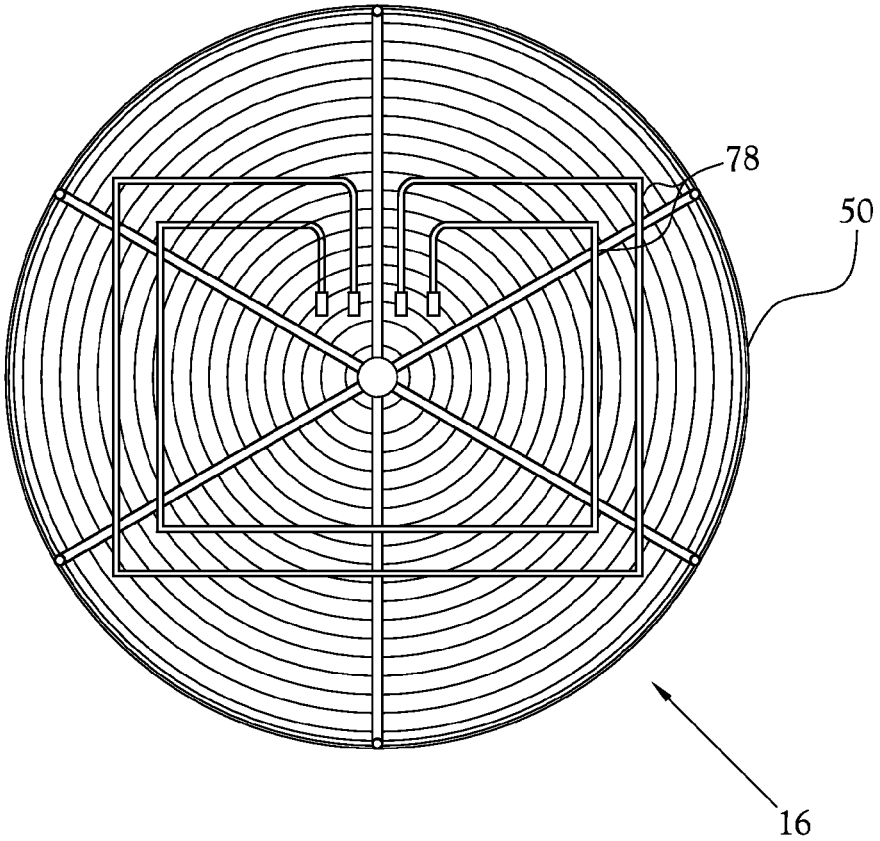
FIG. 5F is a perspective view of one embodiment of the heating element.

FIGS. 5A-5G illustrate diagrams wherein the heating element is configured to provide variable levels of heating for the environment. Variable levels of heating for the environment are determinable by user controls, altering the surface area of the heating element, arrangement of the heating element, or the like. For example, as illustrated in FIGS. 5A-D, power may be provided by any power source 66 (FIG. 5A), the electrical connection 24 (FIG. 5B) provided by the ceiling fan 12, an independent 120 volt power supply 68 (FIG. 5C), or an independent 240 volt power supply 70 (FIG. 5D). Furthermore, as depicted in FIG. 5A, the controls for the heating assembly 16 include a time control 72 to automatically turn on or off the heating assembly 16. Alternatively, as illustrated by FIGS. 5B-D, placing a rheostat 74 further allows a user to adjust the power supplied to the heating assembly 16 to increase or decrease the temperature at which the heating assembly 16 operates. Inclusion of any of the above controls further increase the energy efficiency of the heating assembly 16 and decreased the cost and saves money for heating an area.

Figure 5G:
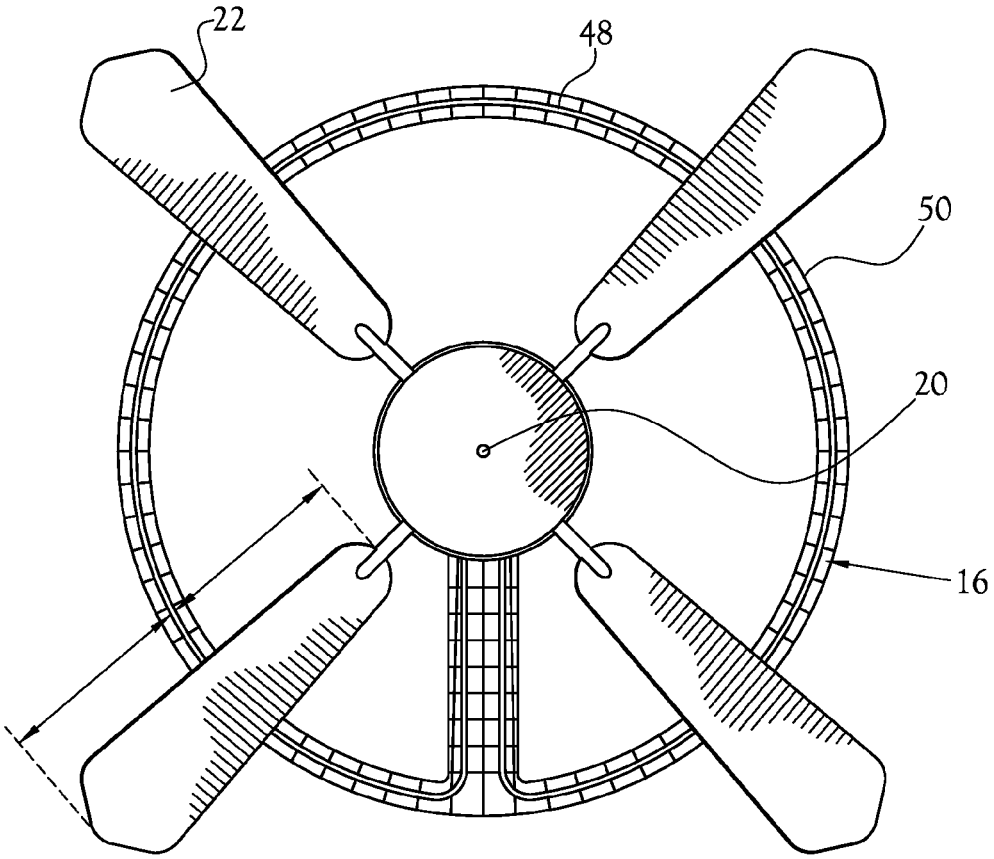
FIG. 5G is a plan view of one embodiment of the ceiling fan and the lighting and heating assembly of the present invention, showing the area in the plane which the heating assembly may occupy.

Alternatively, the heating characteristics of the heating assembly 16 are adjustable by varying the shape and number of the heating element 48. For example, the surface area of the heating element 48 is increased by including a series of concentric circles 76 each having a smaller radius than the previous, or a series of rectangles 78 in which each rectangle has a smaller rectangle within the interior. Lastly, the exposure of the heating element 48 is maximized by positioning the heating element 48 to extend outwardly from the vertical axis 20 a distance of about half the length of the individual lengths of the fan blades 18. As illustrated in FIG. 5G, the heating element 48 is positioned around the vertical axis 20 at distances between the inside edge and outside edge of the fan blades 18 such that the position of the heating element 48 is in the direct air flow generated by ceiling fan 12.

Figure 6:
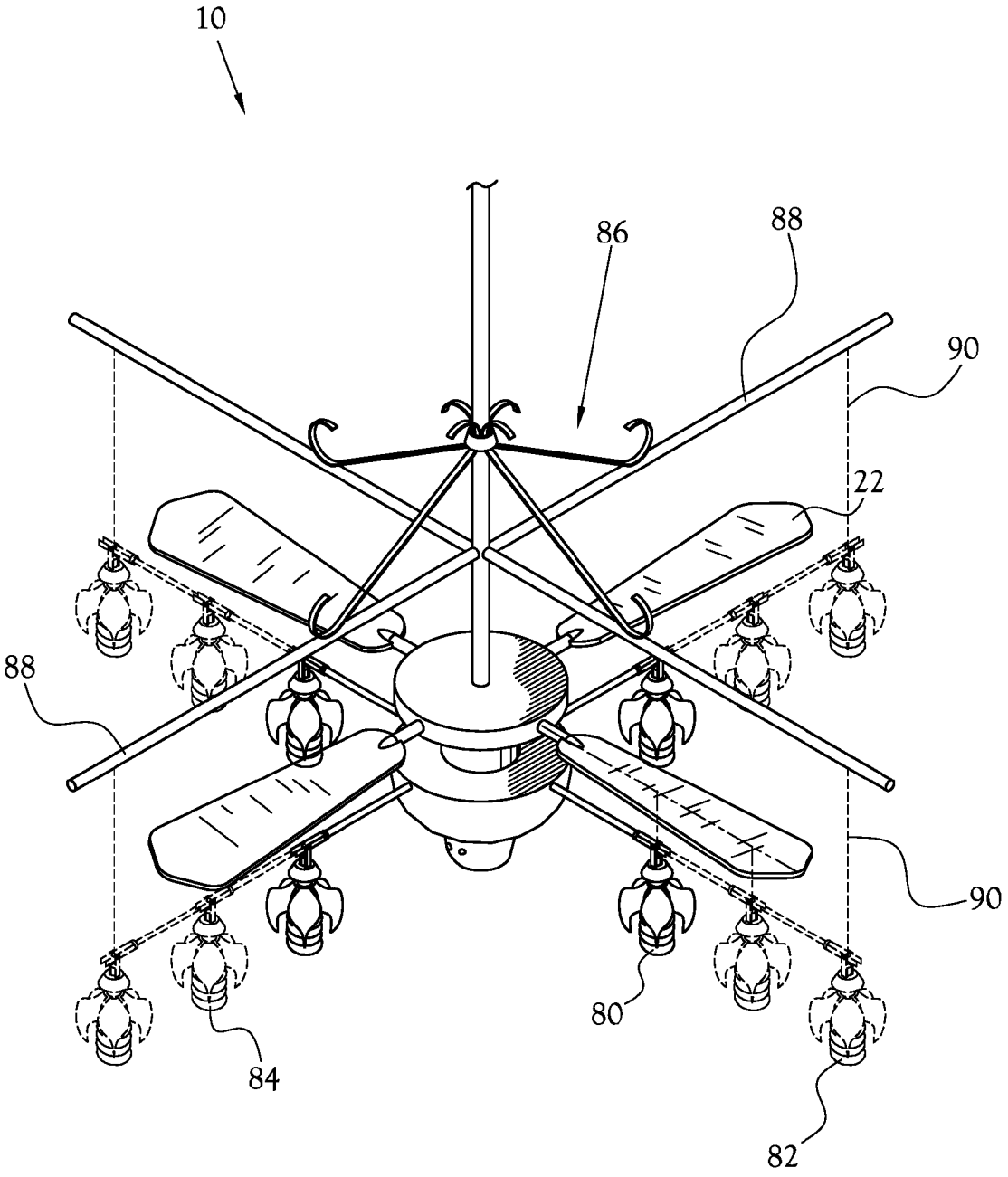
FIG. 6 is a perspective view of one embodiment of the present invention including telescoping lighting arms and showing the available support provided by the upper support.

FIG. 6 illustrates a ceiling having one embodiment of the lighting and heating assembly 10 secured thereto is provided. As depicted, the lighting and heating assembly 10 has the heating assembly 16 detached from the lighting assembly 14 such that the ceiling fan 12 only supports the lighting assembly 14. This functionality allows a user to selectively utilize the lighting and heating assembly 10 such that the user enjoys the benefits of the lighting assembly 14 without the heating assembly 16. In the embodiment illustrated in FIG. 6, the lighting assembly 14 includes telescoping lighting arms 36 configured to extend the socket 40 between a first location 80 and a second location 82, namely a location proximate the housing 30 and position remote from the housing 30, respectively. In the first position 80 the lighting arms 36 support the light bulbs 46 in a relatively small radius about the vertical line 20 such that lighting is generally directed to the area below lighting and heating assembly 10. This arrangement provides a greater concentration of light for performing activities, such as reading. Moreover, in the first position 80, the lighting assembly 14 positions the light bulbs 46 at a position of direct air flow generated by ceiling fan 12 between the inside edge and outside edge of the fan blades 18. Additionally, this placement is ideal for ionizers, such as anion bulbs, for maximum exposure of air flow generated by the ceiling fan 12 and thereby providing the maximum amount of purification. In the second position 82, the lighting arms 36 support the light bulbs at a larger radius from the vertical line 20 such that lighting is directed into a larger portion of the environment, or even the entire environment, thereby reducing the necessity of using additional lighting throughout the environment. Alternatively, the user can position the lighting arms 36 between the first position 80 and second position 82, such as the interim position 84, which provides lighting as desired.

In one embodiment, the lighting and heating assembly 10 includes additional support for reducing deflection of the lighting arms 32 when fully extended. For example, in FIG. 6, the lighting and heating assembly 10 includes an upper support 86. The upper support 86 is attached to the tubing 14 for the ceiling fan 12 and includes members 88 that extend outward from the tubing 14 to a position in register with the lighting arms 36. More specifically, the distal end of a lighting arm 36 is connected to a distal end of members 88 of the upper support 86 by a readily attachable and detachable cable 90, which allows the upper support 86 to be selectively utilized in supporting the lighting assembly 14. In alternate embodiments, the members 88 are securable to the ceiling by the cable 90.

While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. A lighting and heating assembly for a ceiling fan, the ceiling fan being suspended by tubing and having a plurality of blades about a vertical line to move air in a desired direction when the plurality of blades are rotated and an attachment interface having an electrical connection for powering an external assembly, said ceiling fan lighting and heating assembly comprising:

a lighting assembly adapted to be operatively connected to and supported by the attachment interface of the ceiling fan, said lighting assembly comprising a housing and an arm, said housing including an auxiliary connection in electrical communication with a power source other than the electrical connection of the ceiling fan, said arm extending outwardly from said housing and carrying a socket adapted to receive a light bulb for lighting an environment, said socket adapted to be placed in electrical communication with the electrical connection of the ceiling fan;

a light bulb shield defining an opening having a first diameter, said opening configured to receive a first portion of the light bulb having a diameter smaller than the first diameter such that said light bulb shield rests against a second portion of the light bulb having a diameter larger than the first diameter; and a heating assembly detachably connected to said lighting assembly such that said lighting assembly remains operatively connected to the ceiling fan during the detachment of said heating assembly, said heating assembly comprising a heating element and a heating element cage, said heating element having at least one connector to detachably connect said heating element to said auxiliary connection for receiving power such that said heating element is adapted to radiate heat, said heating element cage comprising a heating element support fabricated from a material that is not thermally conductive, said heating element support thermally isolating said cage from said heating element, said heating element cage defining a plurality of openings allowing the air moved by the ceiling fan to flow past said heating element and be heated by said heating element before passing into the environment.

2. The lighting and heating assembly of claim 1 wherein said arm is telescoping allowing said socket to be moved between a first position and a second position, said first position supporting the light bulb proximate the vertical line, said second position supporting the light bulb at an extended distance from the vertical line, wherein the light bulbs are positionable along the path defined between said first position and said second position.

3. The lighting and heating assembly of claim 2 wherein said second position extends beyond said heating assembly such that the heating assembly does not impede lighting of the environment.

4. The lighting and heating assembly of claim 2 comprising an upper support, said upper support adapted to be detachably secured to the tubing of the ceiling fan and extending outwardly from the tubing to a position in register with said second position of said arm, said upper support including support members depending from said upper support and detachably connected to said arm, whereby said arm is provided with additional support when extended to said second position.

5. The lighting and heating assembly of claim 4 wherein said heating assembly is supported above the ceiling fan, whereby air moved by the ceiling fan to flow past said heating element and be heated by said heating element before passing along the perimeter of the environment.

6. The lighting and heating assembly of claim 1 wherein said light bulb shield is formed of a heat resistant noncombustible material.

7. The lighting and heating assembly of claim 6 wherein said arm extends outwardly to a location that position said socket proximate the heating assembly such that said light bulb shield provides greater protection of the light bulb from heat radiating from said heating element.

8. The lighting and heating assembly of claim 1 wherein said heating assembly further comprises a rheostat for controlling the power supplied to said heating element, whereby the quantity of air heated by said heating element is adjustable to a desired level.

9. The lighting and heating assembly of claim 1 wherein said socket is hingedly carried by said arm such that the socket is positionable between vertical positions whereby lighting is selectively directed towards a desired area of the environment.

10. A lighting and heating assembly for a ceiling fan, the ceiling fan being suspended by tubing and having a plurality of blades about a vertical line to move air in a desired direction when the plurality of blades are rotated and an attachment interface having an electrical connection for powering an external assembly, said ceiling fan lighting and heating assembly comprising:

a lighting assembly adapted to be connected to and supported by the attachment interface of the ceiling fan, said lighting assembly comprising a housing and a plurality of telescoping arms, said housing including an auxiliary connection in electrical communication with a power source other than the electrical connection of the ceiling fan, said plurality of telescoping arms extending outwardly from said housing and each carrying a socket adapted to be placed in electrical communication with the electrical connection of the ceiling fan and to receive a light bulb for lighting an environment, said a plurality of telescoping arms allowing said socket to be moved between a first position and a second position, said first position supporting the light bulb proximate the vertical line, said second position supporting the light bulb at an extended distance from the vertical line, wherein the light bulbs are positionable along the path defined between said first position and said second position;

a plurality of light bulb shields each defining an opening having a first diameter, said opening configured to receive a first portion of the light bulb having a diameter smaller than the first diameter such that said light bulb shield rests against a second portion of the light bulb having a diameter larger than the first diameter; and a heating assembly detachably connected to said lighting assembly such that said lighting assembly remains operatively connected during to the ceiling fan the detachment of said heating assembly, said heating assembly comprising a heating element and a heating element cage, said heating element having at least one connector to detachably connect said heating element to said auxiliary connection for receiving power such that said heating element is adapted to radiate heat, said heating element cage comprising a heating element support fabricated from a material that is not thermally conductive, said heating element support thermally isolating said cage from said heating element, said heating element cage defining a plurality of openings allowing the air moved by the ceiling fan to flow past said heating element and be heated by said heating element before passing into the environment.

11. The lighting and heating assembly of claim 10 wherein said second position extends beyond said heating assembly such that the heating assembly does not impede lighting of the environment.

12. The lighting and heating assembly of claim 10 comprising an upper support, said upper support adapted to be detachably secured to the tubing of the ceiling fan and extending outwardly from the tubing to a position in register with said second position, said upper support including support members depending from said upper support and detachably connected to said plurality of telescoping arms, whereby said plurality of telescoping arms are provided with additional support when extended to said second position.

13. The lighting and heating assembly of claim 12 wherein said heating assembly is supported above the ceiling fan, whereby air moved by the ceiling fan to flow past said heating element and be heated by said heating element before passing along the perimeter of the environment.

14. The lighting and heating assembly of claim 10 wherein said light bulb shield is formed of a heat resistant noncombustible material.

15. The lighting and heating assembly of claim 14 wherein said plurality of telescoping arms extends outwardly to a location that position each said socket proximate the heating assembly such that said light bulb shield provides greater protection of the light bulb from heat radiating from said heating element.

16. The lighting and heating assembly of claim 10 wherein said heating assembly further comprises a rheostat for controlling the power supplied to said heating element, whereby the quantity of air heated by said heating element is adjustable to a desired level.

17. The lighting and heating assembly of claim 10 wherein said socket is hingedly carried by said arm such that the socket is positionable between vertical positions whereby lighting is selectively directed towards a desired area of the environment.

18. The lighting and heating assembly of claim 10 comprising an anion light bulb supported by said socket and carrying said light bulb shield, said socket being located at said first position such that said anion light bulb is positioned in communication with the air moved by the ceiling fan, whereby the anion light bulb provides for greater purification of the environment.

19. The lighting and heating assembly of claim 1 wherein said heating element is positioned between an inside edge and an outside edge of said plurality of blades thereby allowing for direct exposure of the heating element to the air vertically moved by the ceiling fan.

20. The lighting and heating assembly of claim 10 wherein said heating element is positioned between an inside edge and an outside edge of said plurality of blades thereby allowing for direct exposure of the heating element to the air vertically moved by the ceiling fan.

* * * * *